US005818314A

United States Patent [19]

Baker

[11] Patent Number: 5,818,314

[45] Date of Patent: Oct. 6, 1998

[54] TUNABLE ELECTROMAGNETIC WAVE RESONANT FILTER

[75] Inventor: Gary R. Baker, Santa Maria, Calif.

[73] Assignee: Hughes Electronics Corporation, Los Angeles, Calif.

[21] Appl. No.: 854,866

[22] Filed: May 12, 1997

[51] Int. Cl.[6] ..... H01P 7/04

[52] U.S. Cl. ..... 333/226; 333/233; 333/234

[58] Field of Search ..... 333/222–227, 333/229–235, 207, 209

[56] References Cited

U.S. PATENT DOCUMENTS

| | | | |
|---|---|---|---|
| 2,716,222 | 8/1955 | Smullin | 333/229 |
| 3,121,205 | 2/1964 | Foss | 333/233 |
| 4,728,913 | 3/1988 | Ishikawa et al. | 333/223 X |
| 4,730,174 | 3/1988 | Nishikawa et al. | 333/226 X |
| 4,963,841 | 10/1990 | Sparagna | 333/219.1 X |
| 5,311,160 | 5/1994 | Higuchi et al. | 333/219.1 |

FOREIGN PATENT DOCUMENTS

| | | | |
|---|---|---|---|
| 4-7905 | 1/1992 | Japan | 333/219.1 |
| 6-61713 | 3/1994 | Japan | 333/219.1 |

*Primary Examiner*—Seungsook Ham

*Attorney, Agent, or Firm*—Elizabeth E. Leitereg; Terje Gudmestad; Michael W. Sales

[57] ABSTRACT

There is disclosed a radio frequency device having a housing, a cover disposed atop the housing, and a rod. A fastener such as a nut is attached to the rod and engages the cover. When the fastener is rotated, the cover moves with respect to the housing, thereby changing the volume of the cavity defined by the housing. In this fashion, the device may be tuned to different frequencies. In alternative embodiments, the rod is internally threaded and receives a screw that engages the cover. When the screw is rotated, the volume of the cavity is changed and the device may be tuned.

17 Claims, 4 Drawing Sheets

TUNABLE ELECTROMAGNETIC WAVE RESONANT FILTER

FIELD AND BACKGROUND OF THE INVENTION

The present invention relates generally to radio frequency (RF) devices and more particularly to RF filters.

A conventional RF filter includes a housing defining a cavity. A cover is disposed atop the housing and has a bore in which a tuning screw is seated. Disposed in the housing is a resonator having a flange connected to the housing by bolts. A gap is formed between the top of the resonator and the cover.

The particular frequencies at which a conventional RF filter resonates depend, among other factors, on the size and shape of the housing, the size and shape of the resonator therein, and the size of the gap between the resonator and the cover.

The initial frequency of a filter is the frequency of the filter at a particular initial temperature, usually ambient temperature. The conventional filter described above may be tuned to different initial frequencies by rotating the tuning screw seated in the bore in the cover to move the screw vertically relative to the housing. The tuning screw affects the resonance frequency of the filter by perturbing the electric field.

Tunable filters are advantageous because slight variations in dimensions of filters during manufacturing sometimes prevent filters from having the exact desired initial resonance frequency immediately after manufacturing. Tuning can be an inexpensive method of compensating for these slight manufacturing variations in order to achieve a desired initial resonance frequency. Tuning also permits a filter to be set at a first resonance frequency and then, if desired, to be set at a second resonance frequency.

When the temperature of the conventional RF filter changes, the volume of the cavity changes which, in turn, alters the resonance frequency of the RF filter. Also, the size of the gap between the resonator and the cover changes, which affects the resonance frequency. The change in resonance frequency or frequencies is called a shift. For many applications it is desirable to minimize the shifts in frequency that result from temperature changes. For example, it may be desirable to reduce the frequency shifts that occur in RF filters located in satellites because those RF filters encounter a variety of temperatures when satellite orientation with respect to the sun or another heat source is altered. Frequency shifts can be detrimental to the performance of a filter because the bandwidth of the filter may shift to overlap with the bandwidth of other filters. Also, because some applications require RF filters that have very tightly defined bandwidths, frequency shifts must be minimized to meet the demanding performance specifications of such applications.

Frequency shifts from temperature changes can be reduced slightly by having the resonator composed of a material having a different coefficient of thermal expansion (CTE) than the CTE of the housing. For example, in conventional RF filters the housing may be made of aluminum and the resonator (including the flange) may be made of Invar. Invar is an alloy containing about 64%Fe and about 36%Ni and is known for its low CTE in some temperature ranges. One disadvantage of such filters is that Invar is heavy and the flange, which is bulky, adds significant weight to the filter. Another disadvantage is that Invar is difficult to machine, which can lead to particularly expensive filters because the flange requires machining (e.g., for screwholes) in order to be secured within the housing.

A characteristic of RF filters that affects filter performance is passive intermodulation (PIM). PIM occurs at microwave frequencies (typically 300 megahertz to 30 gigahertz) when metal/metal contact at low interfacial pressure causes RF noise. For most applications, it is desired to minimize or even eliminate PIM. Conventional RF filters, such as the filter described above, are susceptible to significant PIM. High pressure at metal/metal interfaces is necessary to minimize the PIM in such conventional RF filters. The metal/metal interfaces include the interface of the flange and the housing and the interface of the tuning screw and the cover. However, achieving such interfacial pressure requires expensive precision machining of the resonator (including the flange). High pressure on the threads of tuning screws is difficult to obtain and repeat.

Accordingly, there is a need for an RF filter that can be readily tuned and that has reduced PIM. There is also a need for an RF filter having reduced temperature-induced frequency shifts.

SUMMARY OF THE INVENTION

The aforementioned disadvantages of the prior art filters are overcome by an RF device in accordance with the present invention. In general, such a device can be tuned to different resonant frequencies and, in some embodiments, temperature-induced frequency shifts associated with conventional RF filters are reduced.

In particular, an RF device in accordance with the present invention comprises a housing defining a cavity and a cavity volume, a resonator disposed within the cavity, and a rod movably disposed within the cavity. The rod is coupled to the housing such that movement of the rod moves the housing in a manner that impacts the cavity volume and impacts a resonance frequency of the device.

The housing has a first coefficient of thermal expansion (CTE) and the rod has a second CTE. The first CTE may be unequal or equal to the second CTE. The first CTE may be less than the second CTE. The movement of the rod in the device may be caused by thermal expansion.

The housing may comprise at least two opposing walls, and the rod may be coupled to the two opposing walls. One of the two opposing walls may have a concave shape with respect to an interior of the housing.

In one embodiment, the housing defines a bore and the rod has a first end portion terminating at a first end, and a second end portion terminating at a second end. The first end portion of the rod may be attached to the housing. The second end portion of the rod may pass through the bore. In this embodiment, the second end portion of the rod may be threaded, and the RF device may further comprise a nut threadably connected to the second end portion of the rod.

In another embodiment, the second end portion of the rod is internally threaded, and the RF device further comprises a screw having a first end portion adapted to engage the housing and a second end portion threadably engaged to the second end portion of the rod.

In another embodiment, the second end portion of the rod is externally threaded, and the RF device further comprises a nut engaged to an outer surface of the housing and extending into the cavity. The nut is threadably connected to the second end portion of the rod.

The first end portion of the rod may be threaded and the housing may have threads for receiving the rod. At least one of the threads may be disposed in a recess defined by the bottom of the housing.

The housing may further comprise a tube extending around the bore and extending from one of an outer surface of the housing and an inner surface of the housing.

In an alternative embodiment, an RF device according to the present invention comprises: a housing having a bottom and a side wall and defining a cavity, a resonator attached to the bottom, a cover disposed atop the housing and having a bore, and tuning means for tuning the RF device. The tuning means may include a rod having a first end portion terminating at a first end, and a second end portion terminating at a second end. The first end portion of the rod is attached to the bottom of the housing.

The cover may be concave with respect to an interior surface of the bottom of the housing.

The second end portion of the rod may pass through the bore. The second end portion of the rod may be threaded, and the tuning means may further comprise a nut threadably connected to the second end portion of the rod. The tuning means may instead comprise an internally threaded rod and a screw, as described above in connection with a different filter embodiment.

The rod may be composed of a material having a higher coefficient of thermal expansion than the coefficient of thermal expansion of the housing.

DETAILED DESCRIPTION

An RF device in accordance with the present invention can be tuned to different resonance frequencies. Some embodiments of the present invention have reduced temperature-induced frequency shifts. In general, the present invention comprises a housing defining a cavity and a rod movably disposed within the cavity. The rod is coupled to the housing such that movement of the rod moves the housing in a manner that impacts the volume of the cavity and impacts the resonance frequency of the device.

Figure 1:
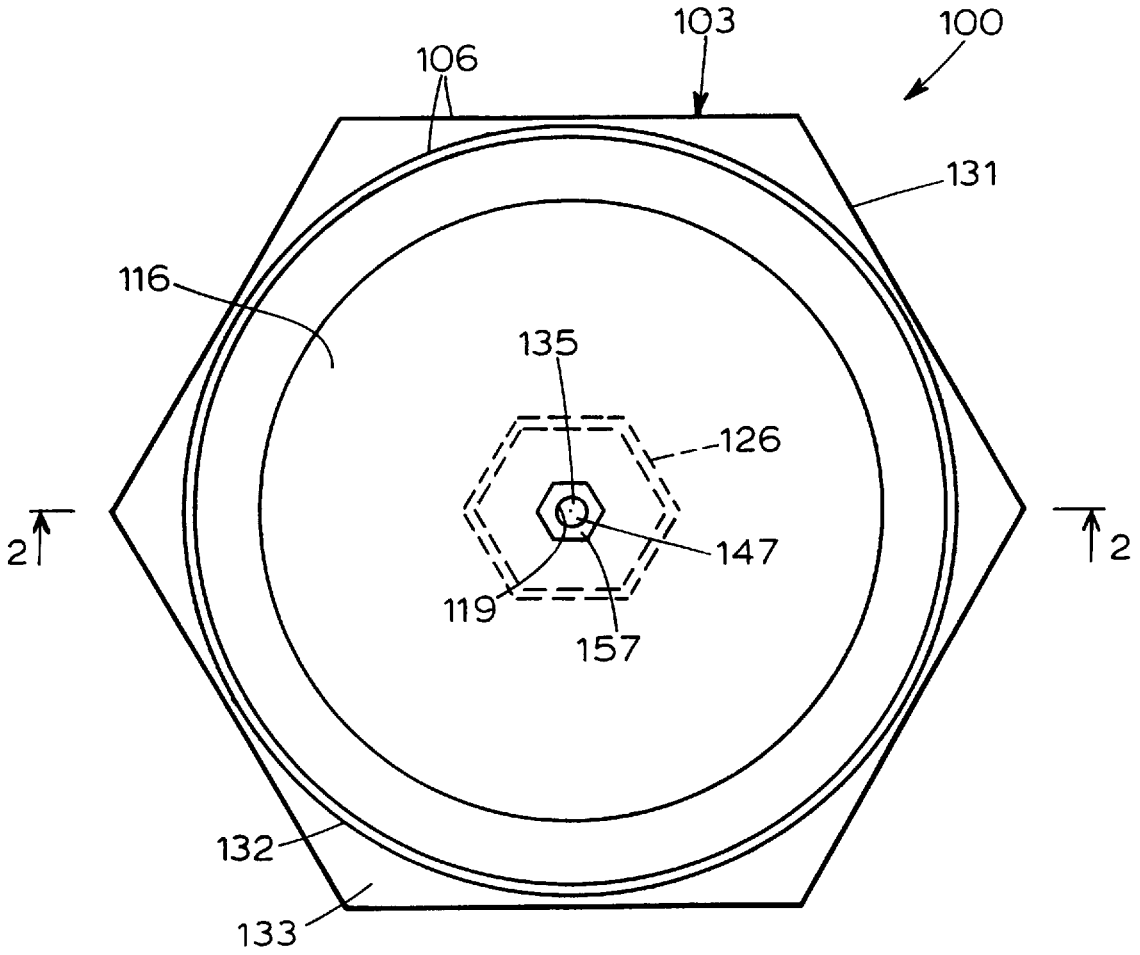
FIG. 1 is a plan view of an RF filter according to the present invention.
Figure 2:
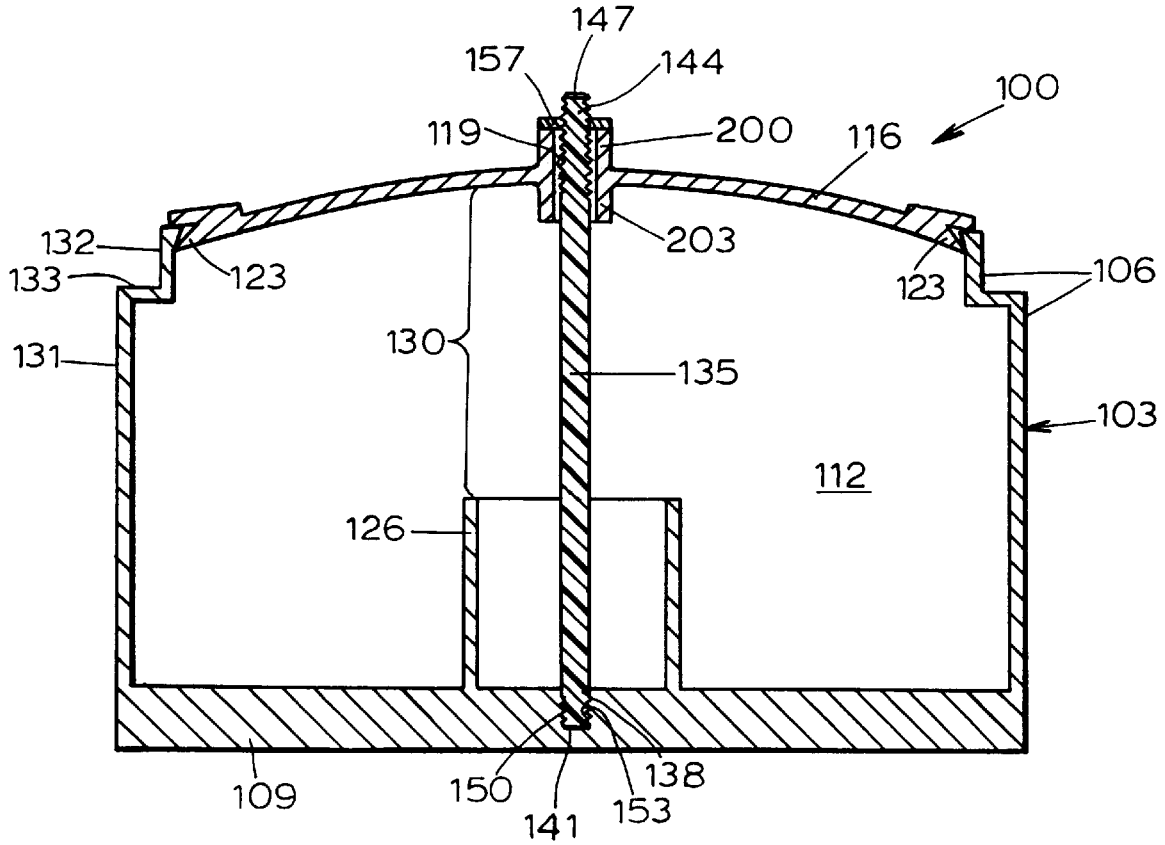
FIG. 2 is a side elevational cross-sectional view of the RF filter of FIG. 2 taken along line 2—2 of FIG. 1.

To the extent practical, the same reference numerals will be used with the same element in each of the figures. Referring to FIGS. 1 and 2, an RF filter according to the present invention is designated generally at 100. The RF filter 100 includes a housing 103 having a side wall 106 and a bottom 109 attached to the side wall 106. A cavity 112 is defined by the housing 103. A cover 116 is disposed atop the side wall 106 of the housing 103 and has a bore 119. The bore 119 in the cover 116 may be located at the center of the cover 116.

Disposed in the housing 103 and extending upwardly from the top surface of the bottom 109 is a resonator 126. The size of a gap 130 between the resonator 126 and the cover 116 is particularly significant for determining the initial resonance frequency of some RF filters. The initial resonance frequency of the RF filter 100 is determined in part by the dimensions of the resonator 126, the dimensions of the housing 103, and the size of the gap 130 between the resonator 126 and the cover 116. The resonance frequency of the filter 100 changes when the volume of the cavity 112 changes or the size of the gap 130 changes, as can occur from tuning with any of various tuning structures discussed below.

Still referring to FIGS. 1 and 2, the filter 100 also comprises structure for tuning the filter 100. Such structure includes a rod 135 having a first end portion 138 (FIG. 2) terminating in a first end 141 (FIG. 2), and a second end portion 144 terminating in a second end 147. The first end portion 138 of the rod 135 is attached to the bottom 109 of the housing 103.

The second end portion 144 of the rod 135 has structure for adjusting the position of the central portion of the cover 116 with respect to the housing 103. In one embodiment, shown in FIGS. 1 and 2, the second end portion 144 of the rod 135 is externally threaded and extends through the bore 119 in the cover 116. In this embodiment the tuning structure includes a nut 157 disposed outside of the cavity 112 and threadably engaged to the second end portion 144. By rotating the nut 157, the volume of the cavity 112 can be adjusted and the size of the gap 130 between the resonator 126 and the cover 116 can be adjusted. The direction that the nut 157 is rotated determines whether the central portion of the cover 116 is raised or lowered with respect to the housing 103.

Tuning by adjusting the position of the central portion of the cover 116 with respect to the housing 103 is considered fine tuning. The RF filter 100 can be fine tuned to become an RF filter for different frequencies without replacing any of the filter components. Thus, fine tuning permits the filter 100 to be set at a first resonance frequency and then, if desired, to be set at a second resonance frequency. Tunable filters are also advantageous because slight variations in dimensions of filters during manufacturing sometimes prevent filters from having the exact desired initial resonance frequency immediately after manufacturing. Fine tuning can be an inexpensive method of compensating for these slight manufacturing variations in order to achieve a desired initial resonance frequency.

Tuning is related to the distance that the central portion of the cover 116 is driven down (or released up) with respect to the housing 103. For example, the more that the cover 116 is lowered with respect to the housing 103, the more that the resonance frequency of the filter 100 lowers. The more that the cover 116 is moved upwardly with respect to the housing 103, the more that the resonance frequency of the filter 100 rises. Fine tuning may be performed when temperature remains constant. Also, fine tuning may be performed to compensate for frequency shifts that occur when the temperature has changed. Frequency shifts are discussed further below.

The cover 116 and the housing 103 may be made from any material so long as the inner surfaces of the cover 116 and the housing 103 are plated to a calculated skin depth with high conductivity metals commonly used in filter designs to prevent RF loss and leakage. Suitable materials include aluminum, Invar, and stainless steel.

The cover 116 may be bowed to put the rod 135 in tension. As shown in FIG. 2, the cover 116 may be concave with respect to the bottom 109 of the housing 103. The cover 116 may instead be convex with respect to the bottom 109 of the housing 103 or flat. The diameter of the rod 135 is determined, in part, by the maximum amount of tension that the cover 116 will be placing on the rod 135 in the temperature range contemplated for the RF filter 100. The amount that the cover 116 bows above or below the top of the side wall 106 while the cover 116 is in a relaxed state depends in part on the diameter of the cover 116.

The cover 116 may be attached to the housing 103 by methods well known in the RF filter art, including methods used for conventional RF filters. One such method includes heating the housing 103 so that the diameter of the side wall 106 expands and cooling the cover 116 in liquid nitrogen so that the cover 116 contracts. The contracted cover 116 is seated on the side wall 106 of the expanded housing 103, and a lower portion 123 of the cover 116 becomes disposed below the top of the side wall 106. The housing 103 then cools to ambient temperature so that the side wall 106 contracts. Also, the cover 116 expands as the cover 116 warms up to ambient temperature, resulting in an interference fit between the cover 116 and the side wall 106. The above method of attaching the cover 116 to the housing 103 results in a removable cover 116 that facilitates access to the interior of the filter 100. However, the cover 116 need not be removable and may instead be attached to the housing 103 by bolts or other suitable means.

The resonator 126 may be integral with the bottom 109 or attached to the bottom 109 by welding or any other suitable means. The height and radius of the resonator 126 necessary to achieve a particular desired resonance frequency may be determined by conventional calculations well known to those skilled in the art. The gap 130 and other factors used to determine optimum dimensions of the resonator 126 are similar to the factors used to determine resonator dimensions for prior art RF filters.

As seen in FIGS. 1 and 2, the side wall 106 may comprise a hexagonal portion 131 extending from the bottom 109, and a circular upper portion 132. In such an embodiment, the cavity 112 defined by the housing 103 has a similar shape as well. A shelf 133 connects the hexagonal portion 131 to the circular upper portion 132. The cover 116 is seated on the circular upper portion 132. The side wall 106 and the cavity 112 defined by the housing 103 may alternatively be circular, square, or any other shape that is suitable for resonance. The height of the side wall 106, relative to the dimensions of the rest of the housing 103, may be nearly any length and is selected to create a desired resonance frequency. Factors for determining the resonance frequency that will result from side walls 106 of particular heights are well known in the RF filter art and include the resulting volume of the cavity 112 and the size of the gap 130 between the resonator 126 and the cover 116.

Figure 4:
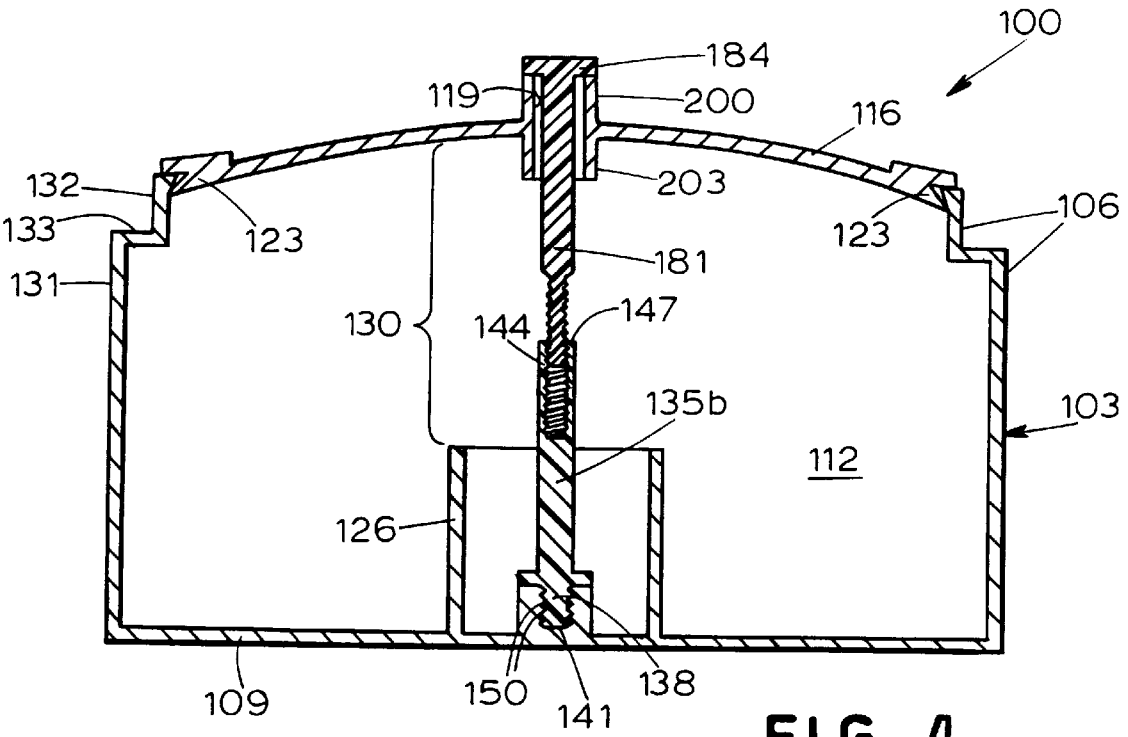
FIG. 4 is a side elevational cross-sectional view of another embodiment of the present invention.
Figure 3:
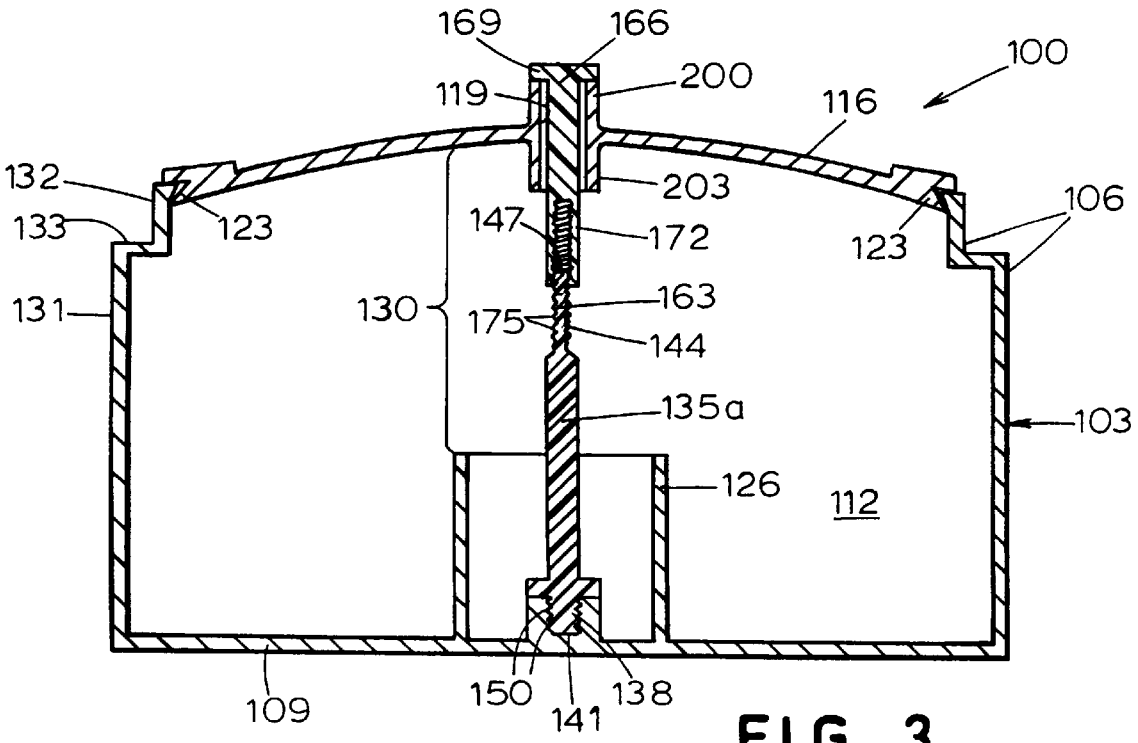
FIG. 3 is a side elevational cross-sectional view of another embodiment of the present invention.
Figure 5:
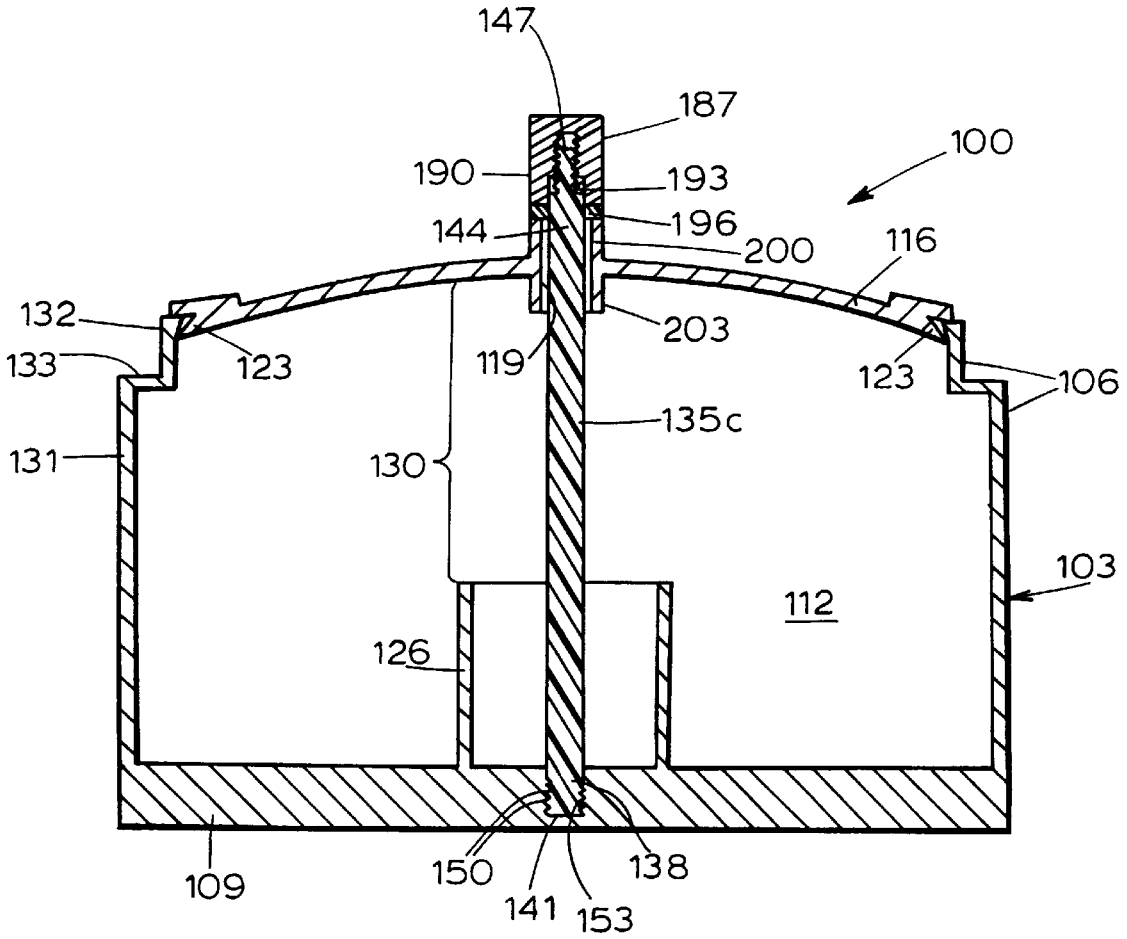
FIG. 5 is a side elevational cross-sectional view of another embodiment of the present invention.

Although the first end portion 138 is shown in FIG. 2 to be attached to the bottom 109 at a location inside the resonator 126, the first end portion 138 may be attached to the bottom 109 outside of the resonator 126. The rod 135 may be attached to the housing 103 by any suitable means. As seen in FIGS. 3 and 4, in embodiments in which the first end portion 138 of the rod 135 is threaded, the bottom 109 of the housing 103 has threads 150 to receive the first end 141 of the rod 135. As seen in FIGS. 2 and 5, the bottom 109 of the housing 103 may have an internally threaded recess 153 for receiving the first end 141 of the rod 135. The rod 135 may be coaxial with the resonator 126. The resonator 126 may be coaxial with the bottom 109.

In another embodiment, shown in FIG. 3, the tuning structure comprises a rod 135*a* that does not extend through the bore 119 in the cover 116. The rod 135*a* has an externally threaded second portion 163. In this embodiment, a nut 166 has a flange 169 that engages the outer surface of the cover 116 adjacent to the bore 119 and has an extension 172 that extends through the bore 119 into the cavity 112. The extension 172 is internally threaded and threadably engages threads 175 of the second end portion 163 of the rod 135*a*. Tuning is accomplished by rotating the nut 166 to raise or lower the nut 166 with respect to the rod 135*a* and thus to adjust the position of the central portion of the cover 116 with respect to the housing 103.

In an alternative embodiment, shown in FIG. 4, the tuning structure comprises an internally threaded rod 135*b* that does not extend through the bore 119. A screw 181 extends through the bore 119 into the cavity 112 to engage the rod 135*b*. The screw 181 can be turned to adjust the position of the central portion of the cover 116 with respect to the housing 103. The screw 181 has a head 184 engaging the outside surface of the cover 116 so that, when the screw 181 is rotated, the central portion of the cover 116 is raised or lowered with respect to the housing 103 and tuning occurs.

Another suitable tuning structure comprises an externally threaded rod 135*c* extending through the bore 119, as seen in FIG. 5. This structure includes a nut 187 having an annular extension 190 defining an annular cavity 193. As the nut 187 is rotated for tuning, the nut 187 moves along a longitudinal axis of the externally threaded rod 135*c*. The annular cavity 193 accommodates the second end portion 144 of the rod 135*c*. As shown, the threaded portion of the rod 135*c* may be narrower than the remaining portion of the rod 135*c* to facilitate engagement with the nut 187. A washer 196 may be disposed between the annular extension 190 of the nut 187 and the cover 116.

Another suitable structure, not shown, for tuning the RF filter 100 is a collet attached to the rod 135 at a location outside of the cavity 112. The collet may be loosened from the rod 135 and tightened at a different location on the rod 135, permitting the central portion of the cover 116 to be set at different positions with respect to the housing 103, thereby adjusting the volume of the cavity 112. The collet may be used in connection with a rod 135 in which the second portion 144 is not threaded.

Referring to FIGS. 1–5 generally, the structures for tuning the filter 100 may be composed of any suitable material including plastic and metal. The rods 135, 135*a*, 135*b*, and 135*c* may be made from any relatively RF transparent plastic. Suitable plastics include nylon, Teflon, and Ultem 1000, a polyetherimide plastic manufactured by GE Plastics. To further lower the CTE of any of the rods 135–135*c*, the rods 135–135*c* can be composed of glass-loaded Ultem.

Any of the rods 135–135*c* may have any diameter smaller than the diameter of the interior of the housing 103 so long as the rods do not interfere with the RF. Because the rods 135–135*c* necessarily have a different dielectric than air regardless of the material that the rods are composed of, the rods may interfere with RF if the rods are too wide. In those embodiments in which the rod extends through the bore 119 (rod 135 (FIGS. 1 and 2), rod 135*c* (FIG. 5)) the second end portion 144 must be narrower than the bore 119 diameter. Also, the second end portion 144 of the rod 135 or rod 135*c* should be free to move with respect to the cover 116 along a longitudinal axis of the bore 119, to permit the position of the central portion of the cover 116 to be adjusted with respect to the housing 103. In these embodiments, the second portion 144 may contact areas of the cover 116 that define the bore 119, however, if the second portion 144 is metal such contact may result in PIM.

As seen in FIGS. 2–5, the cover 116 may comprise an upper tube 200 extending from the outer surface of the cover 116 above and around the bore 119. Additionally or alternatively to the upper tube 200, the cover 116 may comprise a lower tube 203 (FIGS. 2–5) extending from the inner surface of the cover 116 into the cavity 112 and around the bore 119. One or both of the upper and lower tubes 200, 203 may be coaxial with the bore 119. In embodiments having an upper tube 200, the tuning structure engages the upper tube 200.

Because the rods 135–135*c* are relatively RF transparent, the longitudinal dimension of the bore 119 should be of a size that attenuates RF waves to prevent leaks. The longitudinal dimension of the bore 119 is essentially the thickness of areas of the cover 116 adjacent to the bore 119. If necessary, the cover 116 may include either one or both of the upper and lower tubes 200, 203. The length of the upper and lower tubes 200, 203 should be selected to prevent RF leakage. The length of the tube required to cut off RF leakage is related to the diameter of the bore 119. A large diameter bore 119 requires a relatively long upper or lower tube 200, 203, and a small diameter bore 119 requires a relatively short upper or lower tube 200, 203.

The frequencies that the filter 100 is to be used to filter are also a factor for determining tube length. For a particular size bore 119, a high frequency signal will attenuate less than a low frequency signal. Thus, low frequencies, which have a longer wavelength than high frequencies, require shorter upper or lower tubes 200, 203 than high frequencies require for the same attenuation in the same size bore 119. High frequencies require a relatively small diameter bore 119 or relatively long upper or lower tubes 200, 203 to reduce RF leaks from the filter 100.

If the part of the tuning structure that engages the rods 135–135*c* (e.g., nuts 157, 166, 187; screw 181) extends into the cavity 112 and is metal, then the bore 119 should be longer in the longitudinal direction to increase RF attenuation. If the tuning structure fits tightly within the bore 119, then little or no RF leak will occur through the bore 119, but PIM may be a problem if the tightly fitting tuning structure is metal. If instead the tuning structure loosely fits in the bore 119, leakage of RF through the bore 119 is possible and a relatively long bore 119 may be necessary to increase RF absorption. If the screw 181 or nuts 157, 166, 187 of the tuning structure contact the outside surface of the cover 116 but do not contact the areas of the cover 116 defining the bore 119 then PIM is not a problem.

Additionally or alternatively to the tubes 200, 203, RF leaks from the filter 100 may be reduced by placing a metal cap (not shown) atop the rod 135 in embodiments in which the rod is relatively RF transparent and extends through the cover 116. A metal cap may also be placed above the tuning structure if the extended screw 181 (FIG. 4) or extended nut 166 (FIG. 3) are RF transparent. The metal caps reflect RF that passes through the bore 119. The tuning structure of the embodiment of FIG. 5 operates like a metal cap if the inner surface of the nut 187 is metal, because such a nut 187 will prevent leakage of RF through the bore 119.

When temperature changes, the size of the cavity 112 in any of the embodiments of FIGS. 1–5 changes because of thermal expansion or contraction of the housing 103. The resonating frequency of the filter 100 changes as the volume changes. For many applications it is desirable to minimize the frequency shift associated with temperature changes, because frequency shifts may cause the bandwidth of a filter to overlap with the bandwidth of other filters. Also, because some applications require RF filters that have very tightly defined bandwidths, frequency shifts must be minimized to meet the demanding performance specifications of such applications.

In order to reduce the temperature-induced frequency shift of the filter 100, the coefficient of thermal expansion (CTE) of the rods 135–135*c* may be different than the CTE of the housing 103. In such an embodiment, when the filter 100 undergoes a temperature change, the rods 135–135*c* change length at a different rate than the side wall 106 of the housing 103 changes height.

If the CTE of the rods 135–135*c* is higher than the CTE of the housing 103, then, upon heating, the rods 135–135*c* expand faster than the side wall 106 of the housing 103. In that case, assuming the cover 116 is bowed and puts tension on the rods 135–135*c*, the cavity 112 expands because the central portion of the cover 116 follows the tuning structure away from the bottom 109 of the housing 103. The differential of growth between the rods 135–135*c* and the side wall 106 of the housing 103 reduces the frequency shift over temperature changes when the CTE of the rods 135–135*c* is greater than the CTE of the housing 103. The heating of a filter 100 in which the CTE of the rods 135–135*c* is higher than the CTE of the housing 103 results in the frequency shifting down, but shifting down less than the frequency shift of a conventional RF filter when heated. If the RF filter 100 is cooled, the frequency shifts up, but shifts up less than the frequency shift of a conventional RF filter when cooled.

When the CTE of any of the rods 135–135*c* is lower than the CTE of the housing 103, the differential of growth between the rods 135–135*c* and the side wall 106 of the housing 103 increases the frequency shift over temperature changes. Upon cooling, the force between the tuning structure and the cover 116 would decrease (but the tuning structure and the cover 116 would remain in contact if the cover 116 had excess bow). Also upon cooling, the volume of the cavity 112 would decrease less than if the CTE of the rods 135–135*c* were the same or greater than the CTE of the housing 103. Upon heating, the force between the tuning structure and the cover 116 would increase, but the volume of the cavity 112 would increase less than if the CTE of the rods 135–135*c* were the same or higher than the CTE of the housing 103. Thus, a rod 135–135*c* having a CTE lower than the CTE of the housing 103 shifts the frequency down more when heated than a conventional filter when heated. A rod 135–135*c* having a CTE lower than the CTE of the housing 103 shifts the frequency up more when cooled than a conventional filter when cooled.

The temperature compensation performance of the filter 100 can be improved by the selection of a rod material having an appropriate CTE. The temperature compensation of the filter 100 can be easily changed by simply replacing any of the rods 135–135*c* having a first CTE with a corresponding rod 135–135*c* having a second CTE.

The rods 135–135*c* are advantageous because stress analysis of the rods 135–135*c* is relatively simple, making the prediction of the tuning characteristics of a particular rod 135–135*c* relatively easy. Also, thermal expansion curves of the rods 135–135*c* and the housing 103 are relatively easy to analyze, making temperature compensation relatively easy to predict. The rods 135–135*c* are also economical to manufacture and, depending upon the material selected, lightweight. The rods 135–135*c* permit fine tuning without passive intermodulation.

Although the tuning structures discussed above were described as adjusting the position of the central portion of the cover 116 with respect to the housing 103, RF devices without the cover 116 are contemplated. The bottom 109 and the side wall 106 may also be omitted from such RF devices. In such RF filters, a housing defines a cavity, and a rod is movably disposed within the cavity. The rod is coupled to the housing in a manner that impacts the volume of the cavity and impacts the resonance frequency of the RF filter. The rod may be similar to any of the rods 135–135*c*.

The housing of this embodiment may comprise a bore, and this embodiment may comprise any of the tuning structures discussed above in connection with the embodiments of FIGS. 1–5. The movement of the rod may be caused by thermal expansion, and the housing may have a first CTE and the rod may have a second CTE. The first CTE may or may not be equal to the second CTE. If the housing of such an embodiment comprises at least two opposing walls, then the rod may be movably coupled to the two opposing walls. One of the two opposing walls may have a concave shape with respect to an interior of the housing.

EXAMPLE

A filter according to the present invention was assembled. The bottom 109 of the housing 103 was a hexagon measuring 3.4 inches from flat side to flat side in a plane that was parallel to the bottom 109. The housing 103 was made from aluminum and included the hexagonal side wall portion 131 and the circular upper side wall portion 132. The side wall 106 had a height of 1.2 inches from the bottom 109 to the top of the hexagonal portion 131. The height from the shelf 133 to the bottom of the cover 116 was 0.12 inches. The resonator 126 inside the housing 103 was 0.8 inches tall.

The cover 116 was seated on top of the side wall 106, where the side wall 106 was circular. The inner diameter of the circle, where the cover 116 was seated, was 3.3 inches. The bore 119 in the cover 116 was 0.128 inches in diameter and the cover 116 was 0.02 inches thick. The cover 116 had a 0.24 inch upper tube 200 and a 0.24 inch lower tube 203 extending above and below the cover 116, respectively. The tubes 200, 203 were 0.025 inches thick. The cover 116 was placed on the housing 103 by first cooling the cover 116 in liquid nitrogen and heating the housing 103 to give an interference fit. The cover 116 had 0.035–0.040 inches of bow in a relaxed state and the cover 116 was concave with respect to the bottom 109 of the housing 103 when fully relaxed.

The rod 135 was made from Ultem 1000, a plastic manufactured by GE Plastics. The rod 135 in this example had a CTE higher than the CTE of the housing 103. The rod 135 had a diameter of 0.125 inches and was threaded into the bottom 109 of the housing 103. The second end portion 144 of the rod 135 was threaded and extended through the bore 119 in the cover 116. The nut 157 was threaded onto the rod on a portion of the rod 135 extending outside of the cavity 112. The nut 157 was composed of stainless steel, however the nut 157 may be composed of plastic. The bow of the cover 116 provided about 7 foot-pounds of tension on the rod 135 when the nut 157 was in place. Tuning was accomplished by turning the nut 157.

The filter was calibrated so that with approximately 0.020 inches of nut 157 longitudinal movement with respect to the rod 135, the filter 100 could be tuned to compensate for variations that occur within manufacturing tolerances.

The above detailed description is provided for clearness of understanding only and no unnecessary limitations therefrom should be read into the following claims.

What is claimed is:

1. A tunable electromagnetic wave resonant filter comprising:

a housing defining a cavity, a cavity volume, and a bore;

a resonator disposed within said cavity;

a rod disposed within said cavity and having a first end portion and a second end portion;

said first end portion of said rod being fixed to a first portion of said housing; and adjusting means, engaged to said second end portion of said rod and a second portion of said housing, for adjusting an axial position of said second portion of said housing with respect to said resonator.

2. The resonant filter of claim 1 wherein:

said housing comprises a first coefficient of thermal expansion (CTE);

said rod comprises a second CTE; and said first CTE is not equal to said second CTE.

3. The resonant filter of claim 2 wherein:

said housing comprises at least two opposing walls; and said rod is attached to one of said two opposing walls.

4. The resonant filter of claim 3 wherein one of said two opposing walls comprises a concave shape with respect to an interior of said housing.

5. The resonant filter of claim 2 wherein said first CTE is less than said second CTE.

6. The resonant filter of claim 1 wherein said second end portion of said rod passes through said bore.

7. The resonant filter of claim 6 wherein said second end portion of said rod is threaded, and wherein said adjusting means comprises a nut threadably connected to said second end portion of said rod.

8. The resonant filter of claim 1 wherein said second end portion of said rod is internally threaded, and wherein said adjusting means comprises a screw having a first end portion adapted to engage said housing and a second end portion threadably engaged to said second end portion of said rod.

9. The resonant filter of claim 1 wherein said second end portion of said rod is externally threaded, wherein said adjusting means comprises a nut engaged to an outer surface of said housing and extending into said cavity, and wherein said nut is threadably connected to said second end portion of said rod.

10. The resonant filter of claim 1 wherein said first end portion of said rod is threaded and wherein said housing has threads for receiving said rod.

11. The resonant filter of claim 10 wherein at least one of said threads is disposed in a recess defined by said housing.

12. The resonant filter of claim 1 wherein said housing further comprises a tube extending around said bore and extending from one of an outer surface of said housing and an inner surface of said housing.

13. A tunable electromagnetic wave resonant filter comprising:

a housing having a bottom and a side wall;

a resonator attached to said bottom;

a cover disposed atop said housing and having a bore, said cover and said housing defining a cavity having a volume; and tuning means for tuning said resonant filter including:

a rod having a first end portion and a second end portion, wherein said first end portion of said rod is fixed to said bottom of said housing; and adjusting means, engaged to said second end portion of said rod and said cover, for adjusting a position of said cover with respect to said bottom of said housing to alter said cavity volume.

14. The resonant filter of claim 13 wherein said cover is concave with respect to an interior surface of said bottom of said housing.

15. The resonant filter of claim 13 wherein said second end portion of said rod passes through said bore.

16. The resonant filter of claim 15 wherein said second end portion of said rod is threaded, and wherein said adjusting means comprises a nut threadably connected to said second end portion of said rod.

17. The resonant filter of claim 13 wherein said rod is composed of a material having a higher coefficient of thermal expansion than said coefficient of thermal expansion of said housing.

* * * * *